United States Patent [19]

Lewis et al.

[11] 4,394,254

[45] Jul. 19, 1983

[54] METHOD FOR SEPARATING STRAIGHT CHAIN HYDROCARBONS USING ZEOLITES HAVING LARGE CRYSTALS

[75] Inventors: Paul H. Lewis, Groves; Gerald V. Nelson, Nederland, both of Tex.

[73] Assignee: Texaco Inc., White Plains, N.Y.

[21] Appl. No.: 371,840

[22] Filed: Apr. 26, 1982

[51] Int. Cl.[3] ..... C10G 25/03

[52] U.S. Cl. ..... 208/310 Z; 585/950

[58] Field of Search ..... 208/310 Z; 585/950

[56] References Cited

U.S. PATENT DOCUMENTS

| | | | |
|---|---|---|---|
| 2,818,455 | 12/1957 | Ballard et al. | 208/310 Z |
| 2,859,256 | 11/1958 | Hess et al. | 208/310 Z |
| 2,920,037 | 1/1960 | Haensel | 208/310 Z |
| 3,030,431 | 4/1962 | Mattox et al. | 208/310 Z |
| 3,183,182 | 5/1965 | Yeo et al. | 208/310 Z |
| 3,188,293 | 6/1965 | Bacon et al. | 208/310 Z |
| 3,373,103 | 3/1968 | Cooper et al. | 208/310 Z |
| 3,619,418 | 11/1971 | Lewis | 208/310 Z |
| 4,059,505 | 11/1977 | Cartwright et al. | 208/310 Z |
| 4,160,011 | 7/1979 | Estes et al. | 423/328 |

FOREIGN PATENT DOCUMENTS

| | | | |
|---|---|---|---|
| 1009974 | 11/1965 | United Kingdom | 208/310 Z |
| 1026116 | 4/1966 | United Kingdom | 208/310 Z |

*Primary Examiner*—Delbert E. Gantz
*Assistant Examiner*—Glenn Caldarola
*Attorney, Agent, or Firm*—Carl G. Ries; Robert A. Kulason; Martin M. Glazer

[57] ABSTRACT

A method for separating straight chain hydrocarbons from a hydrocarbon fraction having straight chain hydrocarbons, nonstraight chain hydrocarbons, and a sulfur compound, includes the steps of contacting the hydrocarbon fraction with a 5A zeolite having crystals of an average size larger than about 700 angstroms which selectively absorbs the straight chain hydrocarbons to the substantial exclusion of the nonstraight chain hydrocarbons and sulfur compound. Large zeolite crystals are found to have a much longer useful life in this separation method than zeolite crystals having an average size of less than about 700 angstroms as measured along one edge of the zeolite crystal. The hydrocarbon fraction has more than about 800 wppm total sulfur including more than about 15 wppm mercaptan.

23 Claims, 1 Drawing Figure

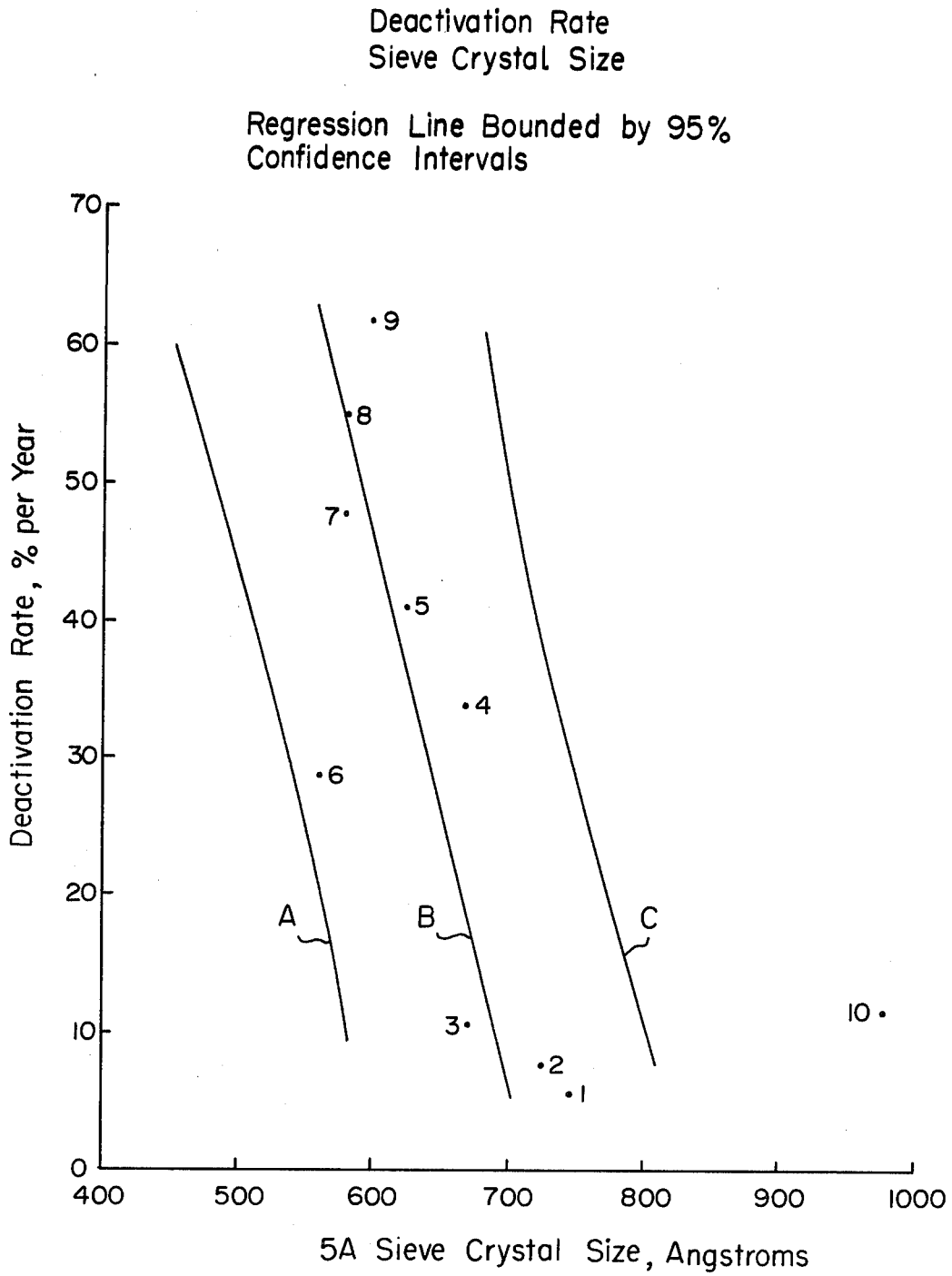
Deactivation Rate
Sieve Crystal Size
Regression Line Bounded by 95%
Confidence Intervals
Deactivation Rate, % per Year
70
60
50
40
30
20
10
0
400
500
600
700
800
900
1000
5A Sieve Crystal Size, Angstroms
A
B
C
1
2
3
4
5
6
7
8
9
10

METHOD FOR SEPARATING STRAIGHT CHAIN HYDROCARBONS USING ZEOLITES HAVING LARGE CRYSTALS

BACKGROUND OF THE INVENTION

1. Field of the Invention

This invention relates to a method for separating straight chain hydrocarbons from a mixture of straight chain hydrocarbons, nonstraight chain hydrocarbons and a sulfur compound; and more particularly to the use of a zeolite having large crystals to effect this separation.

2. Description of the Prior Art

Straight chain hydrocarbons are found mixed with nonstraight chain hydrocarbons in some hydrocarbon or petroleum fractions, such as gasoline, kerosine, diesel, gas oil and naphtha, which fractions can have a boiling range of any where between about 40° C. to 350° C. Straight chain hydrocarbons have commercial utility being useful in the manufacture of detergents. Further, the hydrocarbon fraction remaining after removal of the straight chain hydrocarbons has a higher octane number making it more valuable. For these reasons, and others, it is desirable to separate the straight chain hydrocarbons from the hydrocarbon fractions in which they are found.

One method of separating straight chain hydrocarbons comprises the use of a crystalline zeolite as a selective absorbent for the straight chain hydrocarbons. In such a method, which is described in several patents including coassigned U.S. Pat. Nos. 2,818,455; 2,859,256; and 3,373,103, the mixture of straight chain and nonstraight chain hydrocarbons, preferably in the vapor phase, at an elevated temperature, and at a superatmospheric pressure, is contacted with a crystalline zeolite. The pores of the crystalline zeolite are large enough to permit the entry of the straight chain hydrocarbons, however, they are not large enough for the admission of the nonstraight chain hydrocarbons. The crystalline zeolite selectively absorbs the straight chain hydrocarbons from the mixture.

The remaining portion of the hydrocarbon fraction, which has a large concentration of nonstraight chain hydrocarbons, is then purged from the surface of the zeolite and the area surrounding the zeolite. Purging can be accomplished by first stopping the flow of the hydrocarbon fraction to the zeolite, and then passing a purging medium countercurrent to the flow of the hydrocarbon fraction through the zeolite. After purging, the straight chain hydrocarbons are desorbed from the crystalline zeolite. Other purging methods can include the use of vacuum or the use of noncondensible gases as carbon dioxide or nitrogen.

After purging, the straight chain hydrocarbons can be desorbed from the zeolite by contacting the straight chain saturated zeolite with a desorbing medium, which preferably is a fluid comprising straight chain hydrocarbons in the vapor phase, having a molecular weight less than the molecular weight of the lightest absorbed straight chain hydrocarbon, and also preferably having a lower boiling point than the straight chain hydrocarbons. After the straight chain hydrocarbons are desorbed from the zeolite, they are separated from the desorbing medium and are used as desired. Other desorbing methods can include the use of vacuum or the use of noncondensible gases as carbon dioxide or nitrogen.

In many such processes, especially those employed recently, the hydrocarbon fraction was hydrotreated, such as by catalytically reacting the hydrocarbon fraction with hydrogen, prior to being contacted with the zeolite in order to reduce the concentration of thiophene, mercaptan, and other sulfur compounds in the hydrocarbon fraction. Thiophene, mercaptan, and other sulfur compounds found in the hydrocarbon fraction were generally found to be deleterious to the zeolite, rapidly reducing its capacity for selectively absorbing straight chain hydrocarbons. The hydrogen sulfide produced by hydrotreating the sulfur compounds is readily removed from the treated hydrocarbon fraction leaving a low sulfur content fraction for the separation process. However, hydrotreating is a costly proess due to the cost of hydrogen and the cost of the equipment involved in the hydrotreating process.

SUMMARY OF THE INVENTION

It now has been discovered that straight chain hydrocarbons can be separated from a hydrocarbon fraction having straight chain hydrocarbons, nonstraight chain hydrocarbons, and a sulfur compound, without the rapid destruction of the zeolite as previously encountered, when the zeolite used for the separation is a 5A zeolite and has crystals of an average size larger than about 700 angstroms, the crystal size being measured along one edge of the zeolite crystal.

It has been found that when 5A zeolites having large crystals are used with hydrocarbon fractions, the useful lifetime of the large zeolite crystals is in the order of at least 3 to 4 years, as opposed to the one-half to one year encountered with smaller size zeolite crystals. Further, it also has been discovered that the greater the use of materials which are resistant, or inert, to attack or corrosion by thiophene, mercaptan, and other sulfur compounds in the components of the apparatus which come into contact with the sulfur compound containing fraction, purging medium and desorbing medium during the separation process, the longer the useful life of the large zeolite crystals. This is especially true of those components near the zeolite and those components subjected to heated sulfur compound containing fraction, purging and desorbing medium.

The Preferred Embodiment

A preferred method of separating straight chain hydrocarbons from a hydrocarbon fraction, such as kerosine, containing a sulfur compound, and both straight chain and nonstraight chain hydrocarbons, comprises the steps of contacting the hydrocarbon fraction having more than about 800 parts per million (wppm) by weight of total sulfur including more than about 15 parts per million mercaptan with a 5A zeolite having an average crystal size larger than about 700 angstroms with the crystal size being measured along one edge of the zeolite crystal. The zeolite selectively absorbs the straight chain hydrocarbons to the substantial exclusion of the nonstraight chain hydrocarbons. The straight chain hydrocarbons are then desorbed from the zeolite.

The desorption step can comprise the steps of discontinuing the contacting of the hydrocarbon fraction with the zeolite, then purging the zeolite with a purge medium which preferably has a lower molecular weight than the lightest component of the hydrocarbon fraction. The straight chain hydrocarbon containing zeolite is then contacted with a desorbing medium which is preferably the same as the purge medium and which also has a lower molecular weight than the hydrocarbon fraction. The desorbing medium acts to desorb the straight chain hydrocarbons from the zeolite. The straight chain hydrocarbons can then be separated from the desorbing medium. The purging and desorbing steps can also be accomplished with the use of vacuum or the use of noncondensible gases as carbon dioxide or nitrogen.

During the preferred process a substantial portion of a material which comes into contact with the sulfur compound containing hydrocarbon fraction, purging medium and desorbing medium is resistant to attack by the sulfur compound. Such has been found to further increase the useful life of the large zeolite crystals.

A preferred apparatus used for the separation of straight chain hydrocarbons from the hydrocarbon fraction comprises a vessel in which the large zeolite crystals, having an average crystal size larger than about 700 angstroms, as measured along one edge, are contained. The apparatus further comprises means for conducting the hydrocarbon fraction into and out of the vessel.

Generally, the vessel is a metallic structure, such as a cylinder or other shaped vessel well known in the art. However, the vessel and the conducting means, or substantial portions of the vessel and conducting means which contact the hydrocarbon fraction, and especially those portions subjected to the heated sulfur compound containing purge medium, desorbing medium and fraction and/or those portions near the zeolite, are preferably formed of a material which is resistant, or most preferably inert, to the sulfur and sulfur compounds. The means for conducting the hydrocarbon fraction into and out of the vessel preferably comprise a pipe, conduit or the like, which carries a fluid into and out of the vessel. The conducting means can also comprise means for heating the fraction. The heating means can also be formed of metal, and all or substantial portions of the heating means which contact the fraction are preferably comprised of a material which is resistant, or most preferably inert, to attack or corrosion by sulfur and sulfur containing compounds found in the fraction. Since it is generally the inner surface of the vessel or means which contacts the fraction, those surfaces are preferably formed, or alternatively, lined with the sulfur resistant or inert material. The preferred resistant or inert material is stainless steel, however, other materials which can also be formed into vessels, conduits, pipes, or the like, or used to line these, such as cement and ceramics, are also within the scope of the present invention.

The attack or corrosion of the vessel containing the zeolite and of the conducting means by the sulfur compound is accelerated by heat. Since the temperatures used in the separation process can reach over about 300° C., those components of the apparatus exposed to the higher temperature fraction, such as the heaters, conduits carrying the heated fraction, and the vessel containing the zeolite crystals, are preferably constructed or lined with materials resistant or inert to attack by the sulfur compound.

The use of sulfur resistant or inert materials is preferred since it has been found that iron or other materials which are readily attacked by sulfur compounds, reacted with the sulfur compounds in the fractions, purging medium and desorbing medium to produce iron-sulfur or other sulfur compounds. Upon the regeneration of the zeolite, a gaseous sulfur compound was produced, such as sulfur dioxide ($SO_2$) and sulfur trioxide ($SO_3$), which in turn reacted with the zeolite adding to the premature failure of the zeolite. Stainless steels as well as the other sulfur resistant or inert materials which do not readily react with sulfur compounds, even at high temperatures to produce iron sulfur or other sulfur compounds, eliminate or reduce the quantity of sulfur dioxide and trioxide produced during regeneration.

The substantial reduction or absence of gaseous sulfur compounds formed because of the substantial reduction or absence of iron sulfur compounds present during regeneration has been found to increase the useful life of the zeolite in the process of the present invention. Means for preventing the entry of gaseous sulfur oxide compounds into the zeolite during zeolite regeneration, such as filters, traps, or guard beds comprised of zeolite or other materials which can readily absorb sulfur dioxide, sulfur trioxide and other gaseous sulfur compounds or otherwise prevent their entry into the zeolite beds, can also be used in the present invention. Such means can be used instead of, or to reduce, the quantity of sulfur resistant and inert materials used in the apparatus for separation. With such means some gaseous sulfur oxides can be produced during regeneration without harm to the zeolite because the sulfur oxide gases will be trapped or removed by the means for preventing the entry of gaseous sulfur oxide compounds into the zeolite.

The process of regenerating the zeolite crystals, which is different from the purging or the desorption step, is necessary because of the deposition of coke and hydrocarbons on the surface of the zeolite crystals during the separation process. These deposits degrade the performance of the zeolite crystals. Regeneration is preferably performed by first pumping hot nitrogen gas into the zeolite bed to crack the hydrocarbons into lighter components which then evaporate from the surface of the zeolite crystals. After the nitrogen gas, a hot oxygen-containing gas is pumped through the zeolite bed to burn off any coke on the zeolite crystals. However, the hot oxygen-containing gas also oxidizes any iron-sulfur or other sulfur compounds present in the apparatus to iron or other oxides and gaseous sulfur oxides. It is these gaseous sulfur oxide compounds which are believed to react with the zeolite crystals to degrade and eventually destroy their usefulness.

The straight chain hydrocarbons which are produced by the disclosed process can be any aliphatic hydrocarbons which do not possess side chain branching, such as the normal paraffins and olefins, and the mono or polyolefins, including the straight chain acetylenic hydrocarbons. The nonstraight chain hydrocarbons include aromatic, naphthenic, isoparaffinic, isoolefinic hydrocarbons and the like.

Hydrocarbon fractions which can be treated to separate out straight chain hydrocarbons include various petroleum fractions, such as naphtha, gasoline, diesel oil, kerosine, gas oil, and the like. These hydrocarbon fractions can have a boiling point or boiling range between about 40° C. and about 350° C., and can contain substantial amounts of straight chain hydrocarbons, from about 2 percent to about 35 percent by volume and higher. The preferred process of the present invention can process feedstocks containing up to about 9000 parts per million by weight of total sulfur, including up to about 200 parts per million by weight of mercaptan.

The use of zeolites having large crystals is contrary to previous theories where it was assumed that the crystals of zeolite were degraded by the formation of sulfates in the outer pores of the crystals. Blocking the outer pores of the crystals by the sulfates, which were believed to be formed by sulfur compounds in the feedstock used for the process, was believed to shorten the useful life of the zeolite crystals. The use of small zeolite crystals, it was thought, would produce a a greater number of outer pores per gram of zeolite which in turn would require a significantly greater quantity of sulfates to block the same number of outer pores, than would be required for larger crystals which have a relatively smaller number of outer pores. Further, it was believed that all feeds containing significant sulfur compounds, above about 800 parts per million total sulfur, including more than about 15 parts per million mercaptan, no matter what the zeolite crystal size used, had to be hydrotreated to insure useful zeolite life. However, it now has been discovered that such reasoning is wrong and instead it is now believed that larger crystals, having an average size larger than about 700 angstroms, when measured along one edge of the zeolite crystals, and more resistant to degradation and loss of capacity than the previously preferred smaller crystals, even in the presence of sulfur compounds.

The present preferred zeolite for use in the present invention is a calcium aluminosilicate of the A type. One preferred zeolite is of the 5A type. The crystls of this particular calcium aluminosilicate have a pore size of about 5 angstrom units. This pore size is sufficiently large to admit straight chain hydrocarbons, such as a normal paraffins, and to substantially exclude the non-straight chain hydrocarbons.

The synthesis of A type zeolites is disclosed in several U.S. Patents, including U.S. Patent No. 2,882,243, and coassigned U.S. Pat. No. 4,160,011. Generally, A type zeolites have a three dimensional framework of $SiO_4$ and $AlO_4$ tetrahedera.

The formula for crystalline zeolites is:

$$M_{2/N}O: Al_2O_3: XSiO_2: YH_2O$$

In 5A type zeolites, M is usually calcium and sodium, while X and Y have a definite range which varies for each type of zeolite. One type of a 5A zeolite can contain up to about 10 weight percent sodium. The most preferred 5A type zeolite used in the present invention has had much of the sodium initially present exchanged for calcium, and preferably has a maximum sodium content of about 1.5 weight percent. Further, the most preferred 5A type zeolite has a calcium oxide to aluminum oxide mole ratio of less than 1, and preferably from about 0.8 to about 0.85.

The 5A type zeolite crystals have a cubic crystalline structure. The 5A type zeolite crystals useful in the present invention have an average crystal size larger than about 700 angstroms, and can be much larger, but preferably smaller than about two microns (20,000 angstroms). The average crystal size can be between about 1500 and 5000 angstroms (0.5 microns). In the present invention, crystal size refers to the length of one edge of the crystal, and not to the size of the particles of zeolite which are themselves made up of many crystals.

Methods of forming A type zeolites having desired crystal sizes are known in the art, and some of these methods are disclosed in U.S. Pat. No. 2,882,243. The concentration of reactants, the temperature of the mixture used to form the zeolite crystals, and the length of time in which reactions are carried out to produce the zeolite crystals, are some of the variables that can be changed to alter the size of the zeolite crystals during their production. Higher temeratures and longer reaction times favor the growth of larger crystals, which are preferred in the present invention.

Average crystal size can be measured by x-ray diffraction techniques. In one method, the zeolite crystals are mixed with a reference crystal, such as silicon, having a minimum crystal size of about 1 micron. The mixture is then exposed to x-rays produced by an x-ray tube having a copper target. Methods using x-ray tubes having copper targets produce a much better determination of crystal sizes than those methods using x-ray tubes having molybdenum or other metals as a target. Average crystal size is determined by using the broadening of certain diffraction lines produced by the interaction of the x-rays with the crystals. Average crystal size is preferably measured by comparing the width of certain diffraction lines produced by the zeolite crystals with the width of a silicon diffraction line. Knowing the wave length of the x-rays, one can then readily determine the average size of the zeolite crystals. The average size of the zeolite crystals in Table I, and in the following examples were measured by such a method.

The preferred method of determining average crystal size using x-rays comprises mixing about 10 parts of the zeolite crystals with about 1 part elemental silicon which has a minimum crystal size of about 1 micron. A copper target x-ray tube having a maximum focal line width of 1.3 millimeters was used. Four zeolite peaks were step scanned having Miller index numbers of 300, 311, 410 and 332, and one silicon peak was step scanned having a Miller index number of 111. The line widths of each peak were measured at half maximum intensity. The widths of the 410 and 332 peaks of the A zeolite, and the 111 silicon peak were used to calculate the size of the zeolite crystals.

The crystal sizes were calculated as follows: B was designated as the width of the each one of the A type zeolite peaks, and b was designated as the width of the 111 silicon peak. The widths were measured in degrees. A factor R was calculated for each of the zeolite peaks, wherein R equals the square root of $(B^2-b^2)$. The result for R was found in degrees and this was then converted to radians. The crystal size t was calculated for each zeolite peak as follows:

$$t = \frac{1.542}{R \cos \theta}$$

wherein t was crystal size, 1.542 angstroms was the wave length of the copper x-rays, $\theta$ was the Bragg angle at which the A zeolite peak occurred, and R was as calculated above. The crystal size of the zeolite was computed as the average of the crystal size t computed for the 410 and 332 peaks.

The invention will be better understood from the figures and examples which illustrate the invention but are not meant to limit or otherwise restrict the invention.

BRIEF DESCRIPTION OF THE DRAWING

The FIGURE is a graphic representation of the relationship between the deactivation rate and the crystal size.

EXAMPLE I AND DESCRIPTION OF THE DRAWING

In a commercial separation plant, located outside the United States, a heated vapor phase, sulfur containing kerosine fraction was introduced into the lower end of an absorption vessel. The kerosine fraction was fractionated from a Middle East crude oil and had an API gravity of between about 40 to 45, a distillation range of between about 160° C. and 300° C., a carbon number of between about 10 and 16, a volume of aromatics of between about 17 and 25 percent, volume of olefins of between about 0 and 2 percent, a volume of normal paraffins of between about 20 and 28 percent, volume of iso-paraffins plus naphthenes of between about 45 and 63 percent, a total sulfur content in parts per million by weight (wppm) of between about 1600 and 3300, included within the total sulfur is a mercaptan in wppm of between about 60 and 120 wppm.

The interior of the absorption vessel which had an inner surface of stainless steel, was maintained at an elevated temperature and a superatmospheric pressure. The vessel contained a bed of synthetic calcium and sodium aluminosilicate zeolite of the 5A type. Table I sets forth the point on the FIGURE, the initial installation date, the average effective capacity loss per year, and the average crystal size of several 5A type zeolites used in the separation plant.

Each point on the FIGURE and the data for each point given in Table I are based on a batch of a 5A type zeolite which was installed in the year indicated on Table I. The average effective capacity loss per year indicated on Table I may be based on measurements taken over several years, not only during the year of initial installation. Each point on the FIGURE is based on an individual group of zeolite crystals which were followed from their installation date until either their removal date or the present. Since the operating conditions in the plant did not vary greatly from year to year and since the zeolite crystals were, in many instances, in place for more than one year, it is not believed that the changes in average effective capacity loss per year for each group of zeolite crystals installed varied because of plant operating conditions. The average effective capacity loss per year seems to be relatively constant for each set of zeolite crystals installed over time. Thus, variations in capacity loss for each set of zeolite crystals installed as shown on Table I are believed to be due to the differences in average crystal size and not due to changes in the operating conditions of the plant during the years shown on Table I. For example, the zeolite crystals represented by point 1 on Table I in the FIGURE were used from July, 1975 until February, 1979 with the same low rate of deactivation as shown in Table I. Also, the zeolite crystals represented by point 2 on Table I in the FIGURE were installed in January, 1978 and were still in use as of April, 1982.

In the absorption vessel, the straight chain components of the kerosine feed were selectively absorbed by the zeolite crystals. The treated effluent mixture, which contained a substantially reduced amount of straight chain hydrocarbons, was recovered from the outlet end of the absorption vessel and was sent on to a fractionator from which the nonstraight chain hydrocarbon fraction was recovered and used as desired.

In the absorption step, the kerosine feed was preferably in the vapor phase so as to minimize surface absorption of the kerosine feed on the zeolite crystals. The temperature of the feed, though, was below the cracking point or decomposition point of the kerosine feed. The preferred temperature range for the feed was above the boiling point of the highest boiling point component of the feed and below the cracking temperature of the most easily cracked component of the feed. For the kerosine feed this temperature was about 300° C.

During absorption, the absorption vessel was preferably maintained at a pressure above atmospheric. A useful gage pressure can be from about $5\times10^4$ Pa to about $7\times10^5$ Pa (about 0.5 to about 7 atmospheres).

The feed was introduced into the absorption vessel at a rate which permitted the absorption of the largest quantity of straight chain hydrocarbons in the shortest possible time. Such a charge rate, of course, depends upon the pressure of the feed, the pressure within the vessel, and upon porosity of the zeolite. The feed was continued until the straight chain components of the feed began to break through into the effluent from the vessel. Alternatively, the absorption step could have been carried out for a preset time to achieve a desired loading of the zeolite or stopped short of breakthrough.

After the absorption step ended, the absorption vessel was depressurized to atmospheric pressure or to a pressure slightly above atmospheric pressure. After the depressurizing step, a purge step was begun wherein a purge medium, preferably in the vapor phase, was introduced into the absorption vessel in a direction countercurrent to that of the kerosine feed. The purge step was carried out at substantially the same temperature as the absorption step but at a pressure below that used in the absorption step.

The purge medium removed the remaining portion of the feed from the absorption vessel, and any surface absorbed nonstraight chain components from the zeolite crystals. The quantity of purge medium used was about 0.5 to about 2 times the volume of the absorption vessel. The effluent from the purge step comprised purge medium, kerosine feed and surface absorbed feed, together with some absorbed normal paraffins removed from the zeolite crystals by the purge medium.

After the purge step, the absorption vessel was repressurized to a desorption pressure which varied from about 1 to about 5 atmospheres higher than that used in the absorption step. The desorbing medium was passed into the absorption vessel countercurrent to the feed.

The desorbing medium was generally the same as the purge medium. The use of the same materials avoided the problems of product contamination and simplified the general process requirements. Preferably the desorbing medium comprised a major amount of a gaseous straight chain hydrocarbon, or a mixture of straight chain hydrocarbons, containing at least 3 carbon atoms per molecule, having a boiling point lower than the lightest straight hydrocarbon absorbed into the zeolite, and having an average of about 1 to 3 carbons atoms less than the lightest straight chain hydrocarbon in the feed charged into the absorption vessel. Maintaining a carbon number spread of about 1 to 3 between the lightest component of the feed, and both the purge and desorption medium, permitted effective and rapid desorption times in the present invention and afforded substantially complete separation of the desorbing medium from the desired straight chain hydrocarbons by fractionation.

One preferred purge and desorbing medium comprised about 80 percent by weight normal heptane, when the feed contained hydrocarbons having about 10 to 16 carbon atoms. The process of the present invention produced a component having from about 95 to about 99 percent straight chain hydrocarbons. The purity of the product was controlled by the quantity of purging and desorbing mediums used.

Useful purge and desorbing mediums include n-butane, n-pentane, n-hexane and n-heptane, vacuum or other materials, including those not containing carbon atoms, are also useful, and are well known in the art.

The data from Table I is plotted in the FIGURE. The line (B) is a regression line good for the range of data plotted and represents the relationship between the deactivation rate (dc/dt) and the crystal size L with the error placed in the crystal size. The equation for line (B) is:

$$dc/dt = -0.39L + 280.2.$$

All the data, but for the data of the 5A-3 zeolite (Point 10) was used to calculate line (B). The data for the 5A-3 crystals deviates from the regression line by 7 times the standard deviation of a crystal size determination. Point 10 is included in the plot to show that a 5A zeolite, other than one from the related 5A-1 and 5A-2 zeolites, with crystals as large as 977 angstroms, has a reasonably low deactivation rate.

The relationship between the deactivation rate and the 5A zeolite crystal size, as shown in the above equation, has been tested for significance using both Student's T-test and Spearman's statistical test (both found in W. J. Dixon and F. J. Massey, "Introduction to a Statistical Analysis," McGraw-Hill New York, 1951, pages 157, 164, respectively). Both statistical tests indicate a high level of significance, greater than 99 percent, over the data range test.

The equation above indicates that a crystal size of 693 angstroms is required to obtain a 10 percent deactivation rate per year. The root-mean square deviation of the observed deactivation rate from the regression line using all the data, except point 10, is plus or minus 16.5 percent per year.

Lines (A) and (C) in the FIGURE represents 95 percent confidence intervals and all data except for Point 10 fall between the lines (A) and (C).

Processing variables suspected for being causes for variability in the deactivation rate are changes in charge rate to the vessel, differences in degree of regeneration, differences in feed sulfur content, and differences in feed mercaptan content. Of the feed sulfur changes, alterations in mercaptan content are regarded as being more significant in affecting the deactivation rate. Mercaptans and to some extent other sulfides are decomposed in the separation vessel to form hydrogen sulfide. The hydrogen sulfide is believed to react with the vessel surfaces with which it comes into contact forming sulfides, particularly iron sulfide, since iron is the predominant material in many vessels. The iron sulfide then releases the sulfur as a sulfur oxide during regeneration. It is believed that these sulfur oxides cause the zeolite deterioration. For this reason, it is believed that the use of materials inert or resistant to attack by hydrogen sulfide reduces the zeolite deactivation rate.

Table I and the FIGURE clearly disclose that the effective capacity loss per year of the zeolite decreases as the crystal size of the zeolite crystals increases. The statistical analysis used indicates that such relationship is present even though there is some scatter in the results.

EXAMPLE II

A heated vapor phase, diesel-gas oil fraction is introduced into the lower end of an absorption vessel. The diesel fraction has an API gravity of between about 35 and 42, a distillation range of between about 200° C. and 400° C., a carbon number of between about 12 and 25, a volume of aromatics of between about 14 and 30 percent, a volume of olefins of between about 0 and 4 percent, a volume of normal paraffins of between about 12 and 30 percent, a volume of iso-paraffins plus naphthenes of between about 40 and 70 percent, a total sulfur content in parts per million by weight (wppm) of between about 800 and 9000, included within the total sulfur is a mercaptan in wppm of between about 15 and 200 wppm. The diesel-gas oil fraction is separated as in Example I with results similar to those of Example I.

EXAMPLE III

A heated vapor phase, naphtha-gasoline fraction is introduced into the lower end of an absorption vessel. The fraction has an API gravity of between about 43 and 80, a distillation range of between about 40° C. and 180° C., a carbon number of between about 5 and 10, a volume of aromatics of between about 5 and 60 percent, a volume of olefins of between about 0 and 40 percent, a volume of normal paraffins of between about 10 and 45 percent, a volume of iso-paraffins plus naphthenes of between about 25 and 75 percent, a total sulfur content in parts per million by weight (wppm) of between about 800 and 2000, included within the total sulfur is a mercaptan in wppm of between about 15 and 100 wppm. The naphtha fraction is separated as in Example I with results similar to those of Example I.

The above FIGURE and Examples are not meant to limit the present invention but are only meant to be illustrative, with the present invention being set forth in the following claims.

TABLE I

| Point on Figure | Zeolite | Installation Date (outside of USA) | Average Effective Capacity Loss Per Year | Average Crystal Size in Angstroms by X-ray Diffraction Method |
|---|---|---|---|---|
| 1 | 5A-1 | 1975 | 6% | 746 |
| 2 | 5A-1 | 1978 | 8% | 725 |
| 3 | 5A-2 | 1976 | 11% | 670 |
| 4 | 5A-1 | 1979 | 34% | 667 |
| 5 | " | 1978 | 41% | 622 |
| 6 | " | 1980 | 29% | 562 |
| 7 | " | " | 48% | 577 |
| 8 | " | " | 55% | 581 |
| 9 | " | " | 62% | 597 |
| 10 | 5A-3 | 1977 | 12% | 977 |

What is claimed is:

1. A method for separating straight chain hydrocarbons from a hydrocarbon fraction having straight chain hydrocarbons, nonstraight chain hydrocarbons and a sulfur compound comprising the steps of contacting said hydrocarbon fraction having more than about 800 parts per million by weight of total sulfur including more than about 15 parts per million mercaptan with a 5A zeolite which selectively absorbs said straight chain hydrocarbons to the substantial exclusion of said nonstraight chain hydrocarbons, said zeolite having crystals of an average size larger than about 700 angstroms, said crystal size being measured along one edge of the zeolite crystal; and then desorbing said straight chain hydrocarbons from said zeolite.

2. The method of claim 1 wherein during said steps a substantial portion of an apparatus which comes into contact with said hydrocarbon fraction is resistant to attack by said sulfur compound.

3. The method of claim 1 wherein said hydrocarbon fraction is contacted with said zeolite within a vessel, a substantial portion of said vessel which comes into contact with said hydrocarbon fraction comprises a material resistant to attack by said sulfur compound.

4. The method of claim 3 wherein said material resistant to attack by said sulfur compound is selected from the group consisting of stainless steel, cement, and ceramics.

5. The method of claim 1 wherein the crystals of said 5A zeolite have an average crystal size of between about 700 angstroms and about two microns.

6. The method of claim 1 wherein the crystals of said 5A zeolite have an average crystal size from about 1500 angstroms to less than about 0.5 micron.

7. The method of claim 1 wherein said straight chain hydrocarbons comprise normal paraffins.

8. The method of claim 1 and further comprising the step of regenerating said zeolite after one or more separating and desorbing steps, and means for preventing the entry of a gaseous sulfur oxide compound into said zeolite during the regenerating step.

9. The method of claim 1 wherein said hydrocarbon fraction contains up to about 9000 parts per million by weight of total sulfur, including up to about 200 parts per million by weight of mercaptan.

10. The method of claim 1 wherein said zeolite has a sodium content of below about 1.5 weight percent.

11. The method of claim 1 wherein the step of desorbing said straight chain hydrocarbons comprises the steps of first discontinuing the contacting of said hydrocarbon fraction with said zeolite; then purging said zeolite with a purge medium, said purge medium having a lower molecular weight than the lightest component of said hydrocarbon fraction; contacting said straight chain hydrocarbon containing zeolite with a desorbing medium which desorbs said straight chain hydrocarbons from said zeolite; and then separating said straight chain hydrocarbons from said desorbing medium.

12. The method of claim 11 wherein said desorbing medium comprises a gaseous hydrocarbon containing at least 3 carbon atoms per molecule and having a boiling point lower than the lightest straight chain hydrocarbon absorbed into said zeolite.

13. The method of claim 11 wherein said desorbing medium is selected from the group consisting of n-butane, n-pentane, n-hexane, and n-heptane.

14. The method of claim 1 wherein the average size of the crystals of said zeolite is determined by measuring the broadening of an x-ray diffraction line of said zeolite produced by an x-ray tube having a copper target.

15. The method of claim 1 wherein said hydrocarbon fraction comprises a kerosine fraction having an API gravity of between about 40 and 45, a distillation range of between about 160° C. and 300° C., a carbon number of between about 10 and 16, a volume of aromatics of between about 17 and 25 percent, a volume of olefins of between about 0 and 2 percent, a volume of normal-paraffins of between about 20 and 28 percent, a volume of isoparaffins plus naphthenes of between about 45 and 63 percent, and a total sulfur in wppm of between about 1600 and 3300, included within the total sulfur is a mercaptan content of between about 60 and 120 wppm.

16. The method of claim 1 wherein said hydrocarbon fraction comprises a diesel-gas oil fraction having an API gravity of between about 35 and 42, a distillation range of between about 200° C. and 400° C., a carbon number of between about 12 and 25, a volume of aromatics of between about 14 and 30 percent, a volume of olefins of between about 0 and 4 percent, a volume of normal-paraffins of between about 12 and 30 percent, a volume of isoparaffins plus naphthenes of between about 40 and 70 percent, and a total sulfur in wppm of between about 800 and 9000, included within the total sulfur is a mercaptan content of between about 15 and 200 wppm.

17. The method of claim 1 wherein said hydrocarbon fraction comprises a naphtha-gasoline fraction having an API gravity of between about 43 and 80, a distillation range of between about 40° C. and 180° C., a carbon number of between about 5 and 10, a volume of aromatics of between about 5 and 60 percent, a volume of olefins of between about 0 and 40 percent, a volume of normal-paraffins of between about 10 and 45 percent, a volume of isoparaffins plus naphthenes of between about 25 and 75 percent, and a total sulfur in wppm of between about 800 and 2000, included within the total sulfur is a mercaptan content of between about 15 and 100 wppm.

18. The method of claim 11 wherein during said steps a substantial portion of an apparatus which comes into contact with said sulfur compound containing purging medium and desorbing medium is resistant to attack by said sulfur compound.

19. The method of claim 1 wherein said zeolite has a maximum sodium content of about 10 weight percent.

20. The method of claim 1 wherein the step of desorbing said straight chain hydrocarbons comprises the steps of first discontinuing the contacting of said hydrocarbons with said zeolite; then purging said zeolite with a purge medium, said purge medium comprising a noncondensible gas; contacting said straight chain hydrocarbon containing zeolite with a desorbing medium which desorbs said straight chain hydrocarbons from said zeolite; and the separating said straight chain hydrocarbons from said desorbing medium.

21. The method of claim 20 wherein said desorbing medium and purging medium are selected from a group consisting of carbon dioxide and nitrogen.

22. The method of claim 1 wherein the step of desorbing said straight chain hydrocarbons comprises the steps of first discontinuing the contacting of said hydrocarbon fraction with said zeolite; then purging said zeolite with a vacuum; contacting said straight chain containing zeolite with a vacuum which desorbs said straight chain hydrocarbons from said zeolite; and then separating said straight chain hydrocarbons from said purging medium.

23. A method for separating straight chain hydrocarbons from a hydrocarbon fraction having straight chain hydrocarbons, nonstraight chain hydrocarbons, and a sulfur compound comprising the steps of contacting said hydrocarbon fraction with a 5A zeolite which selectively absorbs said straight chain hydrocarbons to the substantial exclusion of said nonstraight chain hydrocarbons, said hydrocarbon fraction having more than about 800 and up to about 9000 parts per million by weight of total sulfur including more than about 15 and up to about 200 parts per million of mercaptan, said zeolite having crystals of an average size larger than about 700 angstroms, said crystal size being measured along one edge of the zeolite crystal; desorbing said straight chain hydrocarbons from said zeolite; regenerating said zeolite after one or more separating and desorbing steps; and during said steps substantially preventing said hydrocarbon fraction from contacting an apparatus not resistant to attack by said sulphur compound.

* * * * *